US006390849B1

(12) United States Patent
Yamanashi et al.

(10) Patent No.: US 6,390,849 B1
(45) Date of Patent: May 21, 2002

(54) TERMINAL HOLDING STRUCTURE

(75) Inventors: Makoto Yamanashi; Takuya Hasegawa, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/551,639

(22) Filed: Apr. 19, 2000

(30) Foreign Application Priority Data

Apr. 23, 1999 (JP) ..... 11-117060

(51) Int. Cl.[7] ..... H01R 13/40
(52) U.S. Cl. ..... 439/595; 439/752
(58) Field of Search ..... 439/595, 744, 439/752, 733, 603

(56) References Cited

U.S. PATENT DOCUMENTS 5,618,207 A * 4/1997 Maejima ..... 439/595
5,810,619 A * 9/1998 Miwa ..... 439/595
5,980,318 A * 11/1999 Morello et al. ..... 439/595

FOREIGN PATENT DOCUMENTS

JP 9-17507 1/1997

* cited by examiner

*Primary Examiner*—Brian Sircus
*Assistant Examiner*—Son V. Nguyen
(74) *Attorney, Agent, or Firm*—Morgan, Lewis & Bockius LLP

(57) ABSTRACT

A terminal holding structure wherein a terminal fitting 23 is received within a terminal chamber 22 provided with a flexible lance 26 projecting from one of inner walls 24 and 25 facing with each other by establishing the engagement of the lance 26 in a bore 38 formed on a box portion 29 of the terminal fitting 23. The inner wall 25 facing the lance 26 is provided with a backlash stopper 36 which, in a state where the extent of engagement of the lance 26 in the bore 38 is not subject to decrease, creates a clearance between itself and the box portion 29, and in a state where the extent of engagement is subject to decrease, prevents a decrease in extent of engagement by making contact with the box portion 29.

2 Claims, 5 Drawing Sheets

TERMINAL HOLDING STRUCTURE

BACKGROUND OF THE INVENTION

The present invention relates to a terminal holding structure wherein a terminal fitting provided at the distal end of the electrical lead is accommodated in a terminal chamber in a connector housing.

FIG. 5 illustrates a related structure wherein a terminal fitting (female terminal) 3 is received and held in a terminal chamber 2 in a connector housing 1. The terminal chamber 2 has a lance 6 projecting from one inner wall 4. The lance 6 includes, as shown in FIG. 6A, a step portion 8 on the tip of the flexible arm portion 7. The step portion 8 is engaged in a bore 10 formed on the box portion 9 of the terminal fitting 3. Formed on one side of the terminal chamber 2 is a stopper wall 11 to prevent the terminal fitting 3 from passing through that side. The other side of the terminal chamber 2 is an opening for insertion for inserting the terminal fitting 3 into the terminal chamber 2. The lance 6 projects toward the stopper wall 11 and is prevented from being disconnected from the other side of the terminal chamber 2 by engaging the bore 10 formed on the terminal fitting 3 with the step portion 8.

The height of the terminal chamber 2 is selected such that the terminal fitting 3 can be inserted easily and that a clearance is created between the terminal fitting 3 and an inner wall 5 opposing to the inner wall 4 even when the terminal fitting 3 is pressed by the lance 6 toward the inner wall 5. Therefore, when a force is exerted on the terminal fitting 3 in the direction of disconnection by pulling the lead 12, the terminal fitting 3 moves to an extent (within the range of clearance play).

In such a terminal holding structure, in order to hold the terminal fitting 3 in the terminal chamber 2, the terminal fitting 3 is inserted from the side of opening for insertion of the terminal chamber 2, and when the terminal fitting 3 and the lance 6 comes in contact with each other, the terminal fitting 3 is further inserted toward the stopper wall 11. When the terminal fitting 3 is inserted toward the stopper wall 11, the lance 6 deforms, and when the bore 10 is located over the step portion 8 of the lance 6, the bore 10 is engaged with the step portion 8. At this time, the extent of engagement of the bore 10 with the step portion 8 is, as shown in FIG. 6A, a sufficient length of L1. In this situation, the terminal fitting 3 is held in connected state by means of the lance 6.

However, when the terminal fitting 3 is pulled by pulling the lead 12, the terminal fitting 3 moves in the terminal chamber 2 within the range of clearance play as described above, and consequently, the extent of engagement L2 of the bore 10 with the step portion 8 decreases, and thus the force exerted by the lance 6 to hold the terminal fitting 3 within the terminal chamber 2 decreases by the amount corresponding to the length L3. As a result, when the lead is pulled with a significant force, the lance 6 may be deformed, or in the worst case, may be damaged.

SUMMARY OF THE INVENTION

Accordingly, it is an object of the present invention to present a terminal holding structure wherein the extent of engagement of the bore with the lance does not decrease even when the terminal fitting is moved in the terminal chamber within the range of clearance play by pulling the lead, and thus the reduction in the holding force thereof can be prevented.

In order to achieve the above object, according to the present invention, there is provided a connector housing for accommodating a connector terminal therein, comprising:

a chamber for accommodating the connector terminal, the chamber provided with an opening from which the connector terminal is inserted;

an engagement member formed on a first inner wall of the chamber for engaging with a first portion of the connector terminal so as to prevent the connector terminal from moving toward the opening; and a backlash stopper formed on a second inner wall of the chamber opposing to the first inner wall such that a clearance is created between the connector terminal when the first portion of the connector terminal is completely engaged with the engagement member, but a second portion of the connector terminal is brought into contact with the backlash stopper when the first portion of the connector terminal is almost disengaged from the engagement member.

Preferably, the backlash stopper is arranged closer to the opening than the engagement member.

In such a terminal holding structure, when a force is exerted onto the connector terminal in the direction of disconnection by pulling a lead connected to the connector terminal, if there is a clearance between the backlash stopper and the second portion of the connector terminal, the extent of engagement of the first portion of the connector housing and the engagement member is large enough, and thus the force to hold the connector terminal within the chamber is not reduced.

On the other hand, when the connector terminal moves within the chamber so as not to create a clearance between the backlash stopper and the second portion of the connector terminal, the second portion comes into contact with the backlash stopper to prevent a decrease in the extent of engagement of between the first portion thereof and the engagement member. As a result, even if the connector terminal is moved in the chamber within the range of clearance play, the extent of engagement between the first portion thereof and the engagement member can be kept large enough, ensuring that the connector terminal is held in the chamber.

Preferably, the backlash stopper includes a guide slope on which the second portion of the connector terminal is slid toward such a direction that the first portion of the connector terminal is completely engaged with the engagement member when the second portion of the connector terminal is brought into contact therewith.

In this terminal holding structure, when the connector terminal moves in the chamber so as not to create any clearance between the backlash stopper and the second portion of the connector terminal, the second portion comes in contact with the guide slope on the backlash stopper, and the movement of the connector terminal in the chamber toward the side of the insertion opening urges the connector terminal toward the first inner wall. This prevents a decrease in the extent of engagement between the first portion of the connector terminal and the engagement member, that is, the extent of engagement does not decrease. Consequently, the reduction in the force to hold the connector terminal within the chamber is prevented.

DETAILED DESCRIPTION OF THE PREFERRED EMBODIMENTS

Figure 1A:
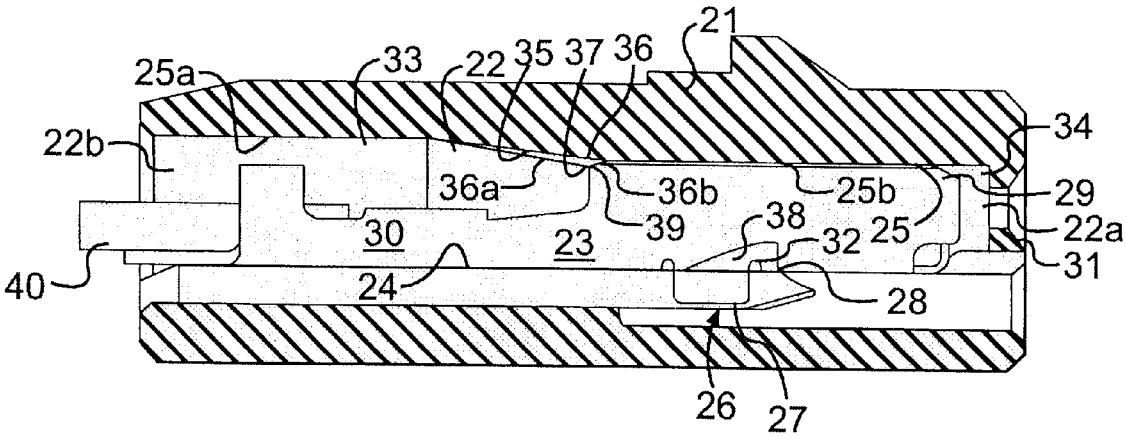
FIG.1A is a cross sectional view showing a terminal fitting held within a terminal chamber of a connector housing according to one embodiment of the present invention.
Figure 1B:
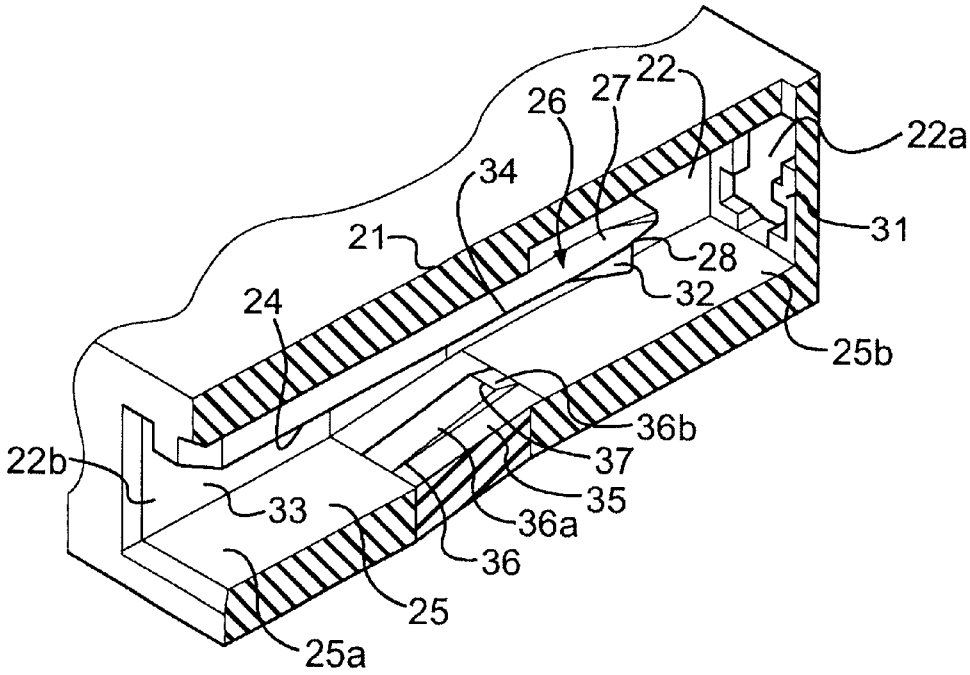
FIG. 1B is a cross sectional perspective view of the connector housing shown in FIG. 1A.

Hereinafter, one embodiment of a terminal holding structure according to the present invention will be described. FIG. 1A is a cross sectional view illustrating a state where a terminal fitting (female terminal) 23 is received in a terminal chamber 22 in a connector housing 21, and FIG. 1B is a cross sectional view illustrating a cross sectional perspective view showing inside of the terminal chamber 22. FIG. 2 to FIG. 4 are cross sectional views illustrating states of the terminal fitting 23 in the terminal chamber 2, and the relation between a backlash stopper 36 and a rear-end corner 39 of the box portion 29.

As shown in FIG. 1A and FIG. 1B, the connector housing 21 is provided with the terminal chamber 22 with both sides opened. On the side where one of openings 22*a* resides, there are provided a stopper wall 31 projected from the edges of the opening. From the opening defined by the stopper wall 31, the mate to this terminal is inserted into the terminal chamber 22. On the side where the other one of opening 22*b* resides, there is provided an opening for insertion through which the terminal fitting 23 is inserted. On one of inner walls 24 of the terminal chamber 22, there is provided a flexible lance 26 projecting toward the stopper wall 31. The lance 26 is composed of an arm portion 27, a step portion 28 formed on the tip of the arm portion 27, and an retaining projection 32.

The other inner wall 25 comprises an inner wall 25*a* on the side where the opening for insertion resides, which defines a receiving portion 33 for receiving a connecting portion 30 of the terminal fitting 23 where the lead is connected by caulking, and an inner wall 25*b* on the side where the box portion resides, which defines the receiving portion 34 for receiving the box portion 29 of the terminal fitting 23, and the inner wall 25*a* on the side where the opening for insertion resides and the inner wall 25*b* on the side where the box portion resides are connected via a slope portion 35.

Between the inner wall 25*a* on the side where the opening for insertion resides and the inner wall 25*b* on the side where the box portion resides of the other inner wall 25, there is provided on about middle section of the slope portion 35 of the backlash stopper 36. The backlash stopper 36 is defined in an angle shape by a slope 36*a* inclining from the inner wall 25*a* on the side where the opening for insertion resides toward the inner wall 25*b* on the side where the box portion resides, and a stopper slope 36*b* inclining from the inner wall 25*b* on the side where the box portion resides toward the inner wall 25*a* on the side where the opening resides. The connecting portion between the slope 36*a* and the stopper slope 36*b* defines an apex portion 37 which projects toward the terminal chamber 22.

The terminal fitting 23 received in the terminal chamber 22 is a female terminal fitting having a box portion 29 where the male terminal fitting is inserted and connected on one side, and a connecting portion 30 where the terminal of the lead is connected by caulking on the other side. On the box portion 29, there is provided an bore 38, and on the box portion 29 on the side of the connecting portion 30 where the lead is connected by caulking, there is provided a rear-end corner 39.

In order to receive the terminal fitting 23 in the terminal chamber 22, the box portion 29 of the terminal fitting 23 is inserted from the side where the opening for insertion 22*b* resides. In the course of insertion of the box portion 29 into the terminal chamber 22, the tip of the box portion 29 comes in contact with a retaining projection formed on the lance 26. By moving the terminal fitting 23 further toward the stopper wall 31, the retaining projection 32 of the lance 26 comes in contact with the peripheral surface of the box portion 29, and the movement of the box portion 29 deforms the lance 26.

Figure 2B:
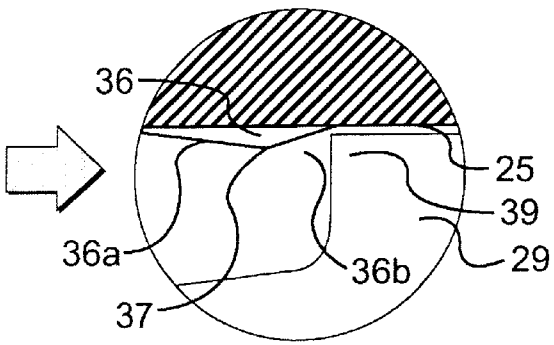
FIG. 2B is a fragmentary expanded view of an engaging portion of the terminal fitting and the connector housing shown in FIG. 2A.
Figure 2A:
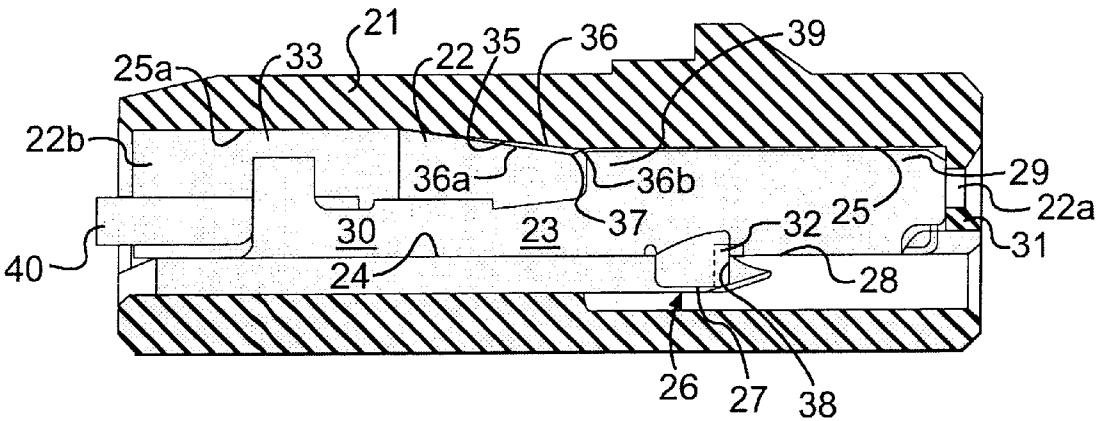
FIG. 2A is a cross sectional view showing the terminal fitting received within the terminal chamber in the normal state.

When the retaining projection 32 slides on the periphery of the box portion 29 and reaches the position over the bore 28, the lance 26 moves toward the other inner wall 25 by its own elasticity and the retaining projection is inserted and engaged in the bore 38. At this time, the extent of insertion of the retaining projection 32 into the bore 38 is the extent of engagement. In this state, as shown in FIGS. 2A and 2B, some degree of clearance is created between the box portion 29 and the other inner wall 25, and also between the box portion 29 and the backlash stopper 36. These clearances exist when the terminal fitting 23 is received in the terminal chamber 22 in normal states.

Figure 3B:
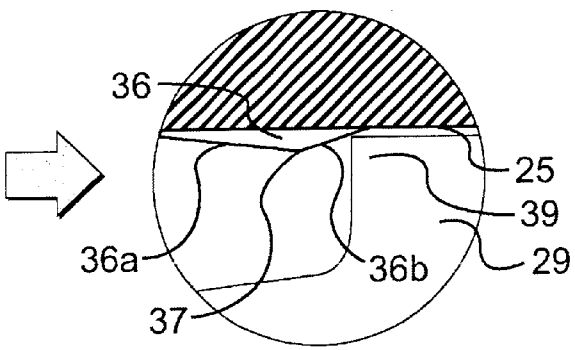
FIG. 3B is a fragmentary expanded view of an engaging portion of the terminal fitting and the connector housing shown in FIG. 3A.
Figure 3A:
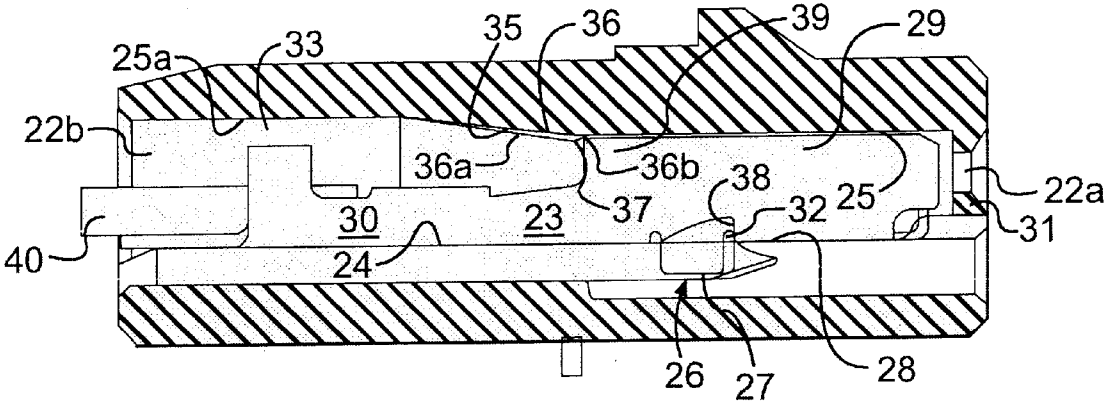
FIG. 3A is a cross sectional view showing a state where the terminal fitting is pulled with a lead but the extent of engagement between a bore and a lance is still large.

When the terminal fitting 23 is pulled from this state toward the opening for insertion 22*b* by an external force such as pulling of the lead 4, the terminal fitting 23 has a tendency that the box portion 29 thereof rotates about the side where the opening for insertion 22*b* resides, and approaches the other inner wall 25. At this time, as shown in FIGS. 3A and 3B, in case where the extent of insertion (extent of engagement) of the retaining projection 32 into the bore 38 does not change, the rear-end corner 39 of the box portion 29 does not come in contact with the backlash stopper 36 and a clearance is created.

Figure 4B:
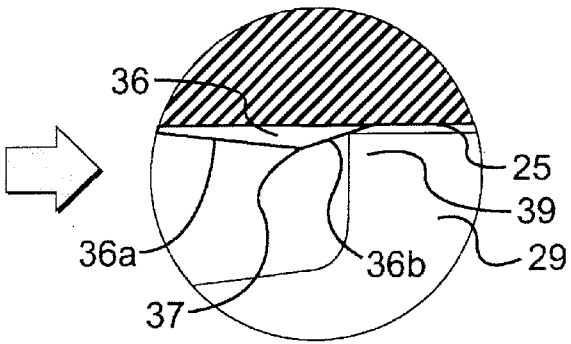
FIG. 4B is a fragmentary expanded view of an engaging portion of the terminal fitting and the connector housing shown in FIG. 4A.
Figure 4A:
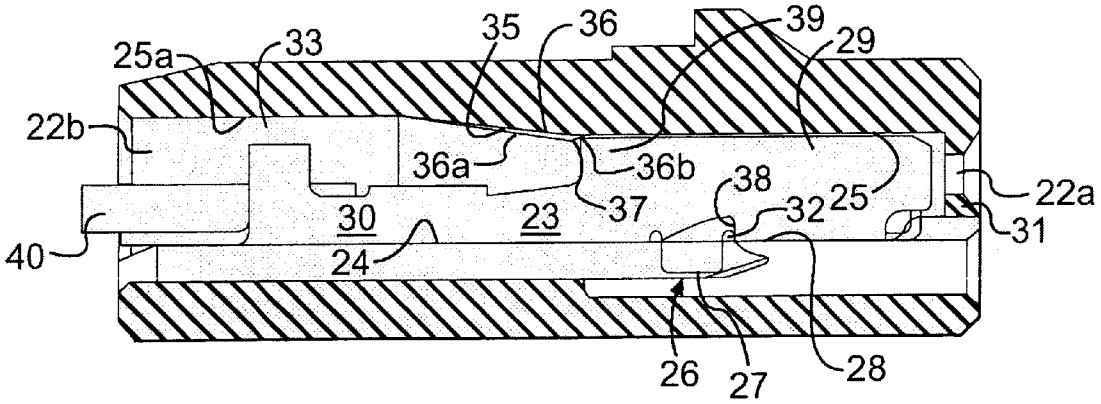
FIG. 4A is a cross sectional view showing a state where the terminal fitting is pulled with the lead and the extent of engagement between a bore and a lance becomes small.
Figure 5:
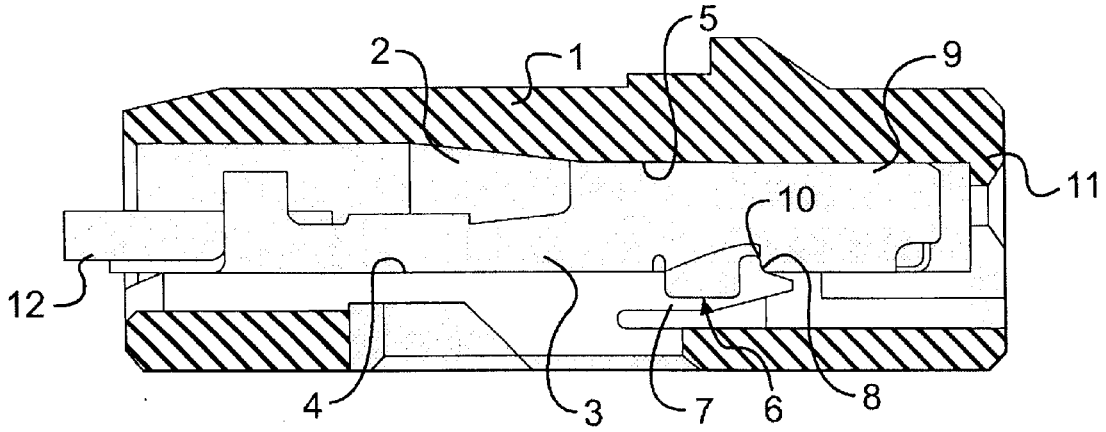
PRIOR ART FIG. 5
FIG. 5 is a cross sectional view showing a terminal fitting held within a terminal chamber of a related connector housing.
Figure 6A:
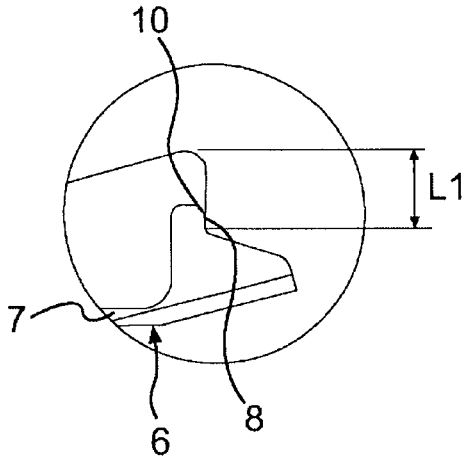
PRIOR ART FIG. 6A
FIG. 6A is a fragmentary expanded view of an engaging portion of the terminal fitting and the related connector housing in a normal state.
Figure 6B:
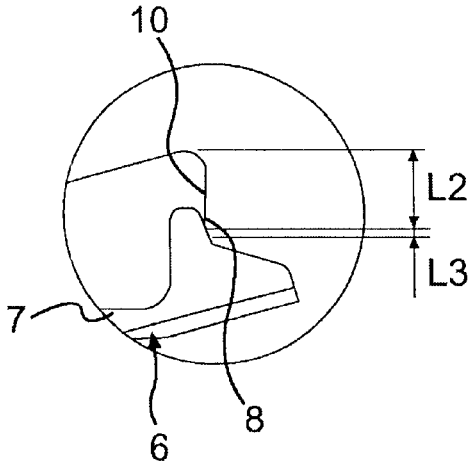
PRIOR ART FIG. 6B
FIG. 6B is a fragmentary expanded view of the engaging portion in a state where the terminal fitting is pulled with a lead.

If the extent of insertion (extent of engagement) of the retaining projection 32 into the bore 38 became smaller when the terminal fitting 23 is pulled, and thus the box portion 29 rotates about the side where the opening for insertion 22*b* resides and approaches the other inner wall 25, as shown in FIGS. 4A and 4B, the rear-end corner 39 of the box portion 29 comes in contact with the stopper slope 36*b* and slides thereon. When the rear-end corner 39 slides on the stopper slope 36*b*, the box portion 29 moves toward one inner wall 24, and then the retaining projection 32 is inserted into the bore 38. As a result, the extent of insertion of the retaining projection 32 into the bore 38 increases and thus the extent of engagement increases.

According to this embodiment, in a case where a force is exerted on the terminal fitting 23 in the direction of disconnection by pulling the lead 40 connected to the terminal fitting 23, if a clearance is created between the backlash stopper 36 and the box portion 29, the extent of engagement of the bore with the lance 26 becomes sufficiently large and the reduction in the force for holding the terminal fitting 23 within the terminal chamber 22 can be prevented.

On the other hand, when the terminal fitting moves within the terminal chamber 22 so as not to create any clearance between the backlash stopper 36 and the box portion 29, the backlash stopper 36 and the box portion 29 come into contact with each other to prevent the reduction in the extent of engagement between the lance 26 and the bore 38. Consequently, the reduction in the force to hold the terminal fitting 23 within the terminal chamber 22 is prevented and the sufficient extent of engagement between the bore 38 and the lance 26 can be established even when the terminal fitting 23 moves in the terminal chamber 22 within the range of clearance play, which ensures that the terminal fitting 23 is held in the terminal chamber 22.

When the terminal moves in the terminal chamber 22 so as not to create any clearance between the backlash stopper 36 and the box portion 29, the rear-end corner 39 of the box portion 29 comes into contact with the stopper slope 36*b* of the backlash stopper 36 to urge the terminal fitting 23 in the terminal chamber 22 toward the side where the opening for insertion 22*b* resides. This prevents the reduction in the extent of engagement between the lance 26 and the bore 38, and therefore a decrease in the extent of engagement can be prevented. Therefore the reduction in the power to hold the terminal fitting 23 within the terminal chamber 22 can be prevented.

While the backlash stopper 36 in an angle shape is employed in the embodiment shown above, it is not limited thereto, and other shapes which can prevent a decrease in the extent of engagement between the bore 38 and the step portion 28 even when the terminal fitting 23 moves in the terminal chamber 22 may be employed.

What is claimed is:

1. A connector housing for accommodating a connector terminal therein, comprising:

a chamber for accommodating the connector terminal, the chamber provided with an opening through which the connector terminal is inserted;

an engagement member formed on a first inner wall of the chamber for engaging with a first portion of the connector terminal so as to prevent the connector terminal from moving toward the opening; and a backlash stopper formed on a second inner wall of the chamber opposed to the first inner wall such that a clearance exists between the connector terminal and the backlash stopper when the first portion of the connector terminal is completely engaged with the engagement member, a second portion of the connector terminal is brought into contact with the backlash stopper when the first portion of the connector terminal is almost disengaged from the engagement member; and wherein the backlash stopper includes a guide slope on which the second portion of the connector terminal is slid toward such a direction that the first portion of the connector terminal is completely engaged with the engagement member when the second portion of the connector terminal is brought into contact with the guide slope.

2. The connector housing as set forth in claim 1, wherein the backlash stopper is arranged closer to the opening than the engagement member.

* * * * *